US006456814B2

(12) United States Patent
Karasawa

(10) Patent No.: US 6,456,814 B2
(45) Date of Patent: Sep. 24, 2002

(54) IMAGE DEVELOPING DEVICE AND IMAGE FORMING APPARATUS PREVENTING TONER FROM ADHERING TO DEVELOPING SLEEVE

(75) Inventor: Kazunori Karasawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/783,317

(22) Filed: Feb. 15, 2001

(30) Foreign Application Priority Data

Feb. 18, 2000 (JP) ..... 2000-041135

(51) Int. Cl.[7] ..... G03G 15/08

(52) U.S. Cl. ..... 399/285; 399/272; 399/260; 399/254; 399/256

(58) Field of Search ..... 399/222, 252, 399/254, 256, 258, 259, 260, 274, 276, 285; 430/122

(56) References Cited

U.S. PATENT DOCUMENTS 4,901,116 A * 2/1990 Haneda et al. ..... 399/273
4,962,394 A 10/1990 Sohmiya et al.
5,006,896 A 4/1991 Koichi et al.
5,038,175 A 8/1991 Sohmiya et al.
5,500,720 A 3/1996 Karasawa
5,768,666 A * 6/1998 Ito et al. ..... 399/273
6,141,509 A 10/2000 Karasawa

OTHER PUBLICATIONS

U.S. patent application Ser. No. 09/614,763, filed Jul. 12, 2000, pending.
U.S. patent application Ser. No. 09/783,317, filed Feb. 15, 2001, pending.

* cited by examiner

*Primary Examiner*—Hoang Ngo
(74) *Attorney, Agent, or Firm*—Oblon, Spivak, McClelland, Maier & Neustadt, P.C.

(57) ABSTRACT

A developing device of an image forming apparatus using a two-component developer including toner and carrier includes a developer stirring device to stir the developer to change the toner of the developer, a developing sleeve to rotate and to carry on its surface the developer, and a conductive doctor blade or configured to regulate a thickness of the developer on the developing sleeve. The doctor blade is either grounded or receives a voltage of an electric polarity opposite to that of the toner. An electric potential of the developing sleeve is set to a same electric polarity as that of the toner, and the toner is moved toward a latent image formed on a photoconductor of the image forming apparatus so as to adhere to the latent image by an electric field formed between the developing sleeve and the latent image on the photoconductor. An average particle diameter of the carrier is about 50 $\mu$m or smaller, and a charge amount of the carrier after the developer has been stirred by the stirring device is about 15 $\mu$c/g or greater.

32 Claims, 6 Drawing Sheets

IMAGE DEVELOPING DEVICE AND IMAGE FORMING APPARATUS PREVENTING TONER FROM ADHERING TO DEVELOPING SLEEVE

CROSS-REFERENCE TO RELATED DOCUMENTS

The present document claims priority and contains subject matter related to Japanese Patent Application No. 2000-041135 filed in the Japanese Patent Office on February 18, 2000, and the entire contents of which is hereby incorporated herein by reference.

BACKGROUND OF THE INVENTION

1. Field of the Invention

The present invention relates to an image developing device for use in image forming apparatuses, such as electrophotographic copying machines, facsimile machines, printers, etc., and more particularly to an image developing device and an image forming apparatus using the developing device to prevent toner from adhering to a developing sleeve of the developing device.

2. Discussion of the Background

In an image forming apparatus using electrophotography, it is well known to use two-component developer including carrier and toner for development. FIG. 5 schematically illustrates an image forming apparatus including a developing device using a two-component developer. FIG. 6 is a diagram for explaining an operation of the developing device.

In FIG. 5, a drum-like shaped photoconductor 101 is rotated in a counterclockwise direction indicated by an arrow by a driving device (not shown). Around the photoconductor 101 are arranged, a charging roller 102, an exposure device 103, a developing device 104, a transfer device 105, a cleaning device 106, and a discharging device 107.

The charging roller 102 uniformly charges the surface of the photoconductor 101. The exposure device 103 irradiates a laser light on the surface of the photoconductor 101, which has been uniformly charged by the charging roller 102, to form a latent image thereupon. The developing device 104 applies toner to the latent image on the surface of the photoconductor 101 to form a toner image. The transfer device 105 transfers the toner image to a transfer sheet. The cleaning device 106 removes residual toner remaining on the surface of the photoconductor 101 after transfer of the toner image to the transfer sheet. Thereafter, the discharging device 107 discharges the surface of the photoconductor 101, which has been cleaned by the cleaning device 106. The image forming apparatus then repeats each of the above-noted operations by the charging roller 102, the exposure device 103, the developing device 104, the transfer device 105, the cleaning device 106, and the discharging device 107 (i.e., a charging process, an exposure process, a developing process, a transfer process, a cleaning process, and a discharging process).

The developing device 104 includes a developer container 108 having an opening formed facing the photoconductor 101, a developing sleeve 109 arranged so as to face the photoconductor 101 in the developer container 108, and a two-component developer 110 accommodated in the developer container 108. The developing device 104 further includes a stirring member 111 configured to stir and to supply the developer 110 to the surface of the developing sleeve 109, and a doctor blade 112 configured to regulate the thickness of the developer 110 carried on the surface of the developing sleeve 109.

The developer 110 includes magnetic carrier and non-magnetic toner, which are mixed with each other. When the developer 110 is stirred by the stirring member 111, the toner of the developer 110 is charged by friction between the toner and the carrier. A magnet (not shown) is arranged within the developing sleeve 109. The developer 110 is held on the surface of the developing sleeve 109 by a magnetic force of the magnet. The developing sleeve 109 is rotated in a direction indicated by an arrow in FIG. 5, and the developer 110 held on the surface of the developing sleeve 109 is moved, after having its thickness regulated by the doctor blade 112, to a space between the photoconductor 101 and the developing sleeve 109. Toner adhered to the carrier held on the surface of the developing sleeve 109 is moved toward a latent image on the photoconductor 101 by an electric field formed between the developing sleeve 109 and the latent image on the photoconductor 101, so as to adhere to the latent image.

Generally, in digital image forming apparatuses using electrophotography, such as laser beam printers or digital copying machines, the photoconductor 101 is charged to the same polarity as that of the toner. When the toner has a negative charge, the electric potential of the photoconductor 101 is set, for example, to −950V, and an electric field is formed as illustrated in FIG. 6. A voltage of the same polarity as that of the toner (e.g., −600V) is applied to the developing sleeve 109. In this case, when the exposure device 103 irradiates a laser beam light to the surface of the photoconductor 101 which has been uniformly charged, the electric potential of non-image (background) parts of the surface of the photoconductor 101 is kept at −950V and the electric potential of image parts thereof is changed to about −100V. Therefore, the electric field between the developing sleeve 109 and the image parts of the photoconductor 101 is directed from the image parts of −100V to the developing sleeve 109 of −600V, and thereby the toner having a negative charge adheres to the image parts of the photoconductor 101. On the other hand, the electric field between the developing sleeve 109 and the non-image parts of the photoconductor 101 is directed from the developing sleeve 109 of −600V to the non-image parts of −950V. Therefore, the toner having a negative charge does not adhere to the non-image parts of the photoconductor 101.

The transfer device 105 transfers a toner image on the surface of the photoconductor 101 to a transfer sheet. The transfer sheet carrying the transferred toner image thereupon is conveyed to a fixing device (not shown). The fixing device fixes the toner image onto the transfer sheet by heating the toner image so as to be melted and by then applying a pressure to the toner image. The electric power consumed by the fixing device when heating and melting a toner image generally occupies a major part of the necessary power of an image forming apparatus.

Recently, from a view point of energy saving, it is desired to reduce power consumption in image forming apparatuses. For meeting such a demand for energy saving it is desired to reduce the temperature at a fixing device when heating and melting a toner image at the fixing device. For reducing the temperature at a fixing device when heating a toner image, the toner must be a type of toner capable of being fixed onto a transfer sheet at a relatively low temperature.

In image forming apparatuses, generally the electric potential difference between the developing sleeve 109 and the non-image parts of the photoconductor 101 is configured such that charged toner of the developer 110 carried on the developing sleeve 109 does not move to non-image (background) parts of the surface of the photoconductor 101. Rather, the electric field having a direction toward the developing sleeve 109 causes the toner to adhere to the developing sleeve 109. When the toner of the type that can be fixed onto a transfer sheet at a relatively high temperature, because of its relatively weak adhering force, even when the toner has once adhered to the developing sleeve 109, the adhered toner is easily removed from the developing sleeve 109 when the adhered toner is rubbed by the developer 110 in the developer container 108.

However, when toner of the type that can be fixed to a transfer sheet at a relatively low temperature is used in the developing device 104, because of its relatively strong adhering force, the toner adhered to the developing sleeve 109 is gradually fixed to the developing sleeve 109, and thereby an insulating layer is formed by the toner on the developing sleeve 109. Such an insulating layer of toner on the developing sleeve 109 causes a problem of hindering development of a latent image by the developing device 104.

SUMMARY OF THE INVENTION

The present invention has been made in view of the above-discussed and other problems and addresses the above-discussed and other problems.

Preferred embodiments of the present invention provide a novel image developing device of an image forming apparatus and a novel image forming apparatus using the developing device, that prevent toner that can be fixed to a transfer sheet at a relatively low temperature from adhering and being fixed to a developing sleeve of the developing device.

According to a preferred of the present invention, a novel image developing device of an image forming apparatus using a two-component developer including toner and carrier includes a developer stirring device configured to stir the developer so as to charge the toner, a developing sleeve configured to rotate and to carry on its surface the developer, and a conductive doctor blade that is grounded and is configured to regulate a thickness of the developer on the developing sleeve. An electric potential of the developing sleeve is set to a same electric polarity as that of the toner, and the toner of the developer carried on the developing sleeve is moved toward a latent image formed on a photoconductor of the image forming apparatus so as to adhere to the latent image by an electric field formed between the developing sleeve and the latent image on the photoconductor. An average particle diameter of the carrier is about 50 $\mu$m or smaller, and a charge amount of the carrier after the developer has been stirred by the stirring device is about 15 $\mu$c/g or greater.

Thus, in a novel image developing device of the present invention using a two-component developer and a reversal development system, a conductive doctor blade of the developing device is grounded so as to peel off toner adhered to a developing sleeve of the developing device, and carrier that has an average particle diameter of about 50 $\mu$m or smaller and a charge amount of about 15 $\mu$c/g or greater after the developer has been stirred by the developer stirring device is used so as to move toner adhered to the doctor blade to the carrier of the developer carried on the developing sleeve by the electric charge of the carrier. Thereby, even when toner that can be fixed to a transfer sheet at a relatively low temperature and that thereby has a relatively strong adhering force is used, the toner is prevented from adhering and being fixed to the developing sleeve.

According to another embodiment of the present invention, a novel image developing device of an image forming apparatus using a two-component developer including toner and carrier includes a developer stirring device to stir the developer so as to charge the toner, a developing sleeve configured to rotate and to carry the developer on its surface, and a conductive doctor blade configured to regulate a thickness of the developer on the developing sleeve. A voltage of an electric polarity opposite to that of the toner is applied to the doctor blade. The toner of the developer carried on the developing sleeve is moved toward a latent image formed on a photoconductor of the image forming apparatus so as to adhere to the latent image by an electric field formed between the developing sleeve and the latent image on the photoconductor. An average particle diameter of the carrier is about 50 $\mu$m or smaller, and a charge amount of the carrier after the developer has been stirred by the developer stirring device is about 15 $\mu$c/g or greater.

Thus, in a novel image developing device of the present invention using a two-component developer a voltage of a polarity opposite to that of toner is applied to a doctor blade of the developing device so as to peel off toner adhered to a developing sleeve of the developing device, and carrier that has an average particle diameter of about 50 $\mu$m or smaller and a charge amount of about 15 $\mu$c/g or greater after the developer has been stirred by the developer stirring device is used so as to move toner adhered to the doctor blade to the carrier of the developer carried on the developing sleeve by an electric charge of the carrier. Thereby, even when toner that can be fixed to a transfer sheet at a relatively low temperature and that has a relatively strong adhering force is used, the toner is prevented from adhering and being fixed to the developing sleeve.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
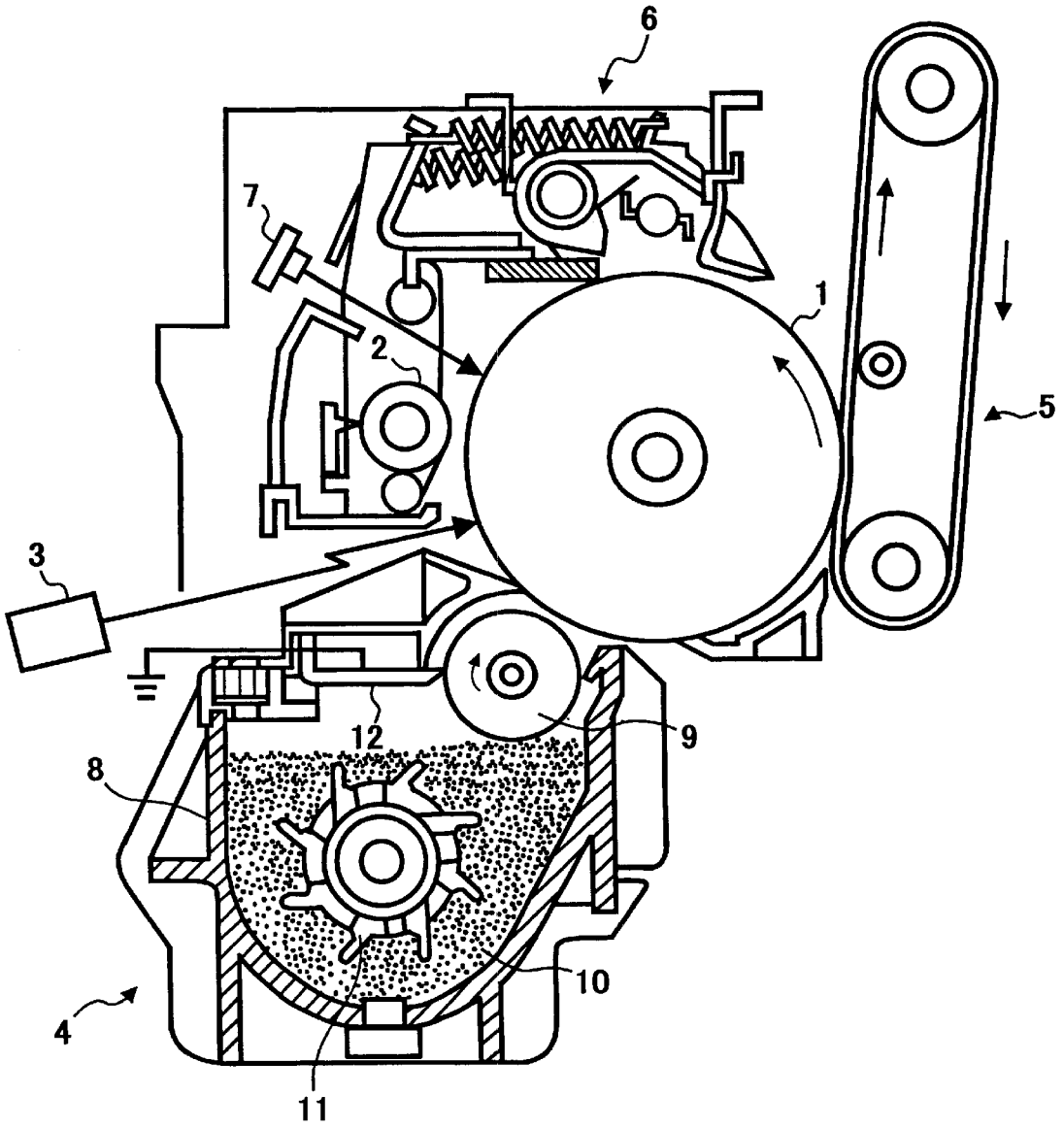
FIG. 1 is a drawing schematically illustrating an image forming apparatus including a developing device according to a preferred embodiment of the present invention.

Referring now to the drawings, wherein like reference numerals designate identical or corresponding parts throughout the several views, preferred embodiments of the present invention are described.

Figure 2:
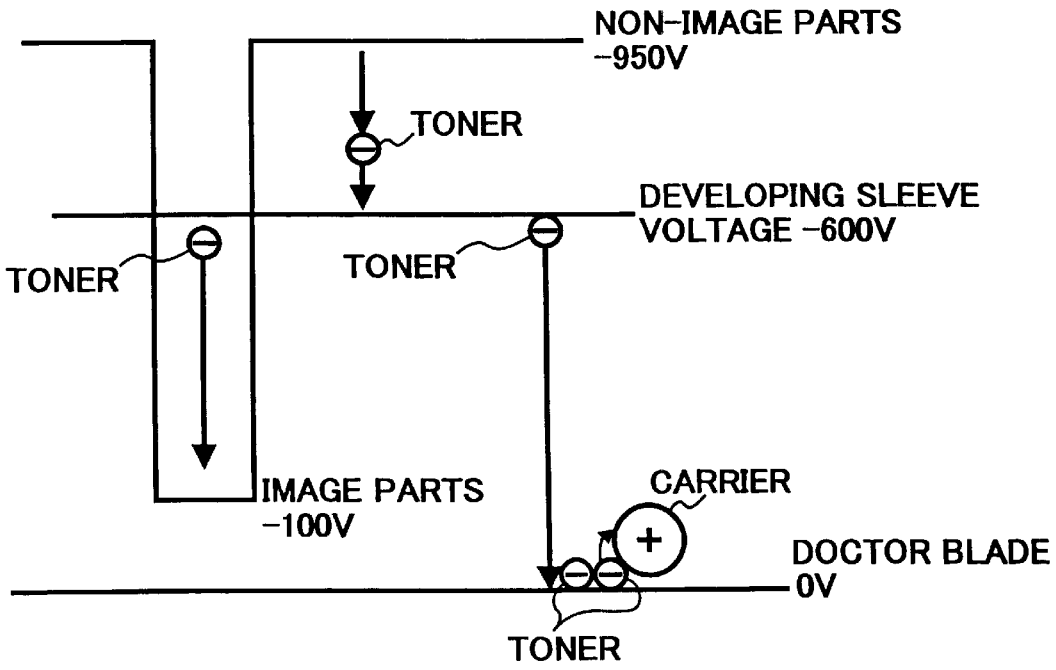
FIG. 2 is a diagram for explaining an operation of the developing device of FIG. 1.

FIG. 1 schematically illustrates an image forming apparatus including a developing device according to a preferred embodiment of the present invention. FIG. 2 is a diagram for explaining an operation of the developing device of FIG. 1.

In FIG. 1, a drum-like shaped photoconductor 1 is rotated in a counterclockwise direction indicated by an arrow by a driving device (not shown). Around the photoconductor 1 are arranged a charging roller 2, an exposure device 3, a developing device 4, a transfer device 5, a cleaning device 6, and a discharging device 7.

The charging roller 2 uniformly charges the surface of the photoconductor 1. The exposure device 3 irradiates a laser light on the surface of the photoconductor 1, which has been uniformly charged, to form a latent image thereupon. The developing device 4 applies toner to the latent image on the surface of the photoconductor 1 to form a toner image. The transfer device 5 transfers the toner image to the transfer sheet. The cleaning device 6 removes residual toner remaining on the surface of the photoconductor 1 after transfer of the toner image to a transfer sheet. The discharging device 7 discharges the surface of the photoconductor 1, which has been cleaned by the cleaning device 6. The image forming apparatus then repeats each of the above-noted charging process, exposure process, developing process, transfer process, cleaning process, and discharging process that are respectively performed by the charging roller 2, the exposure device 3, the developing device 4, the transfer device 5, the cleaning device 6, and the discharging device 7.

The developing device 4 includes a developer container 8 having an opening formed facing the photoconductor 1, a developing sleeve 9 arranged so as to face the photoconductor 1 in the developer container 8, and a two component developer 10 accommodated in the developer container 8. The developing device 4 further includes a stirring member 11 configured to stir and to supply the developer 10 to the surface of the developing sleeve 9, and a doctor blade 12 configured to regulate the thickness of the developer 10 carried on the surface of the developing sleeve 9.

The developer 10 includes magnetic carrier and non-magnetic toner, which are mixed with each other. When the developer 10 is stirred by the stirring member 11, the toner of the developer 10 is charged by friction between the toner and the carrier. A magnet (not shown) is arranged within the developing sleeve 9. The developer 10 is held on the surface of the developing sleeve 9 by a magnetic force of the magnet. The developing sleeve 9 is rotated in a direction indicated by an arrow in FIG. 1, and the developer 10 held on the surface of the developing sleeve 9 is moved, after having its thickness regulated by the doctor blade 12, to a space between the photoconductor 1 and the developing sleeve 9. Toner adhered to the carrier held on the surface of the developing sleeve 9 is moved to a latent image on the photoconductor 1 by an electric field formed between the developing sleeve 9 and the latent image on the photoconductor 1, so as to adhere to the latent image.

The doctor blade 12 of the developing device 4 is formed by a conductive member. The developing sleeve 9 is charged to the same polarity as that of the toner, and the toner is moved to a latent image formed on the photoconductor 1 by an electric field formed by the developing sleeve 9 and the latent image on the photoconductor 1, so as to adhere to the latent image. Such a developing device as the developing device 4 is referred to as a reversal developing device using a reversal development system (negative-to-positive development system). The doctor blade 12 is grounded. The average particle diameter of carrier used in the developer 10 is preferably 50 $\mu$m or smaller, and the charging amount thereof after the developer 10 has been stirred by the stirring member 11 is preferably 15 $\mu$c/g or greater.

In the developing device 4, when the toner has a negative charge, the electric potential of the photoconductor 1 is set, for example, to −950V, and an electric field is formed as illustrated in FIG. 2. A voltage of the same polarity as that of the toner (e.g., −600V) is applied to the developing sleeve 9. In this case, when the exposure device 3 irradiates a laser beam light to the surface of the photoconductor 1, which has been uniformly charged, the electric potential of non-image (background) parts of the surface of the photoconductor 1 is kept at −950V, and the electric potential of image parts thereof is changed to about −100V. Therefore, the electric field between the developing sleeve 9 and the image parts of the photoconductor 1 is directed from the image parts of −100V to the developing sleeve 9 of −600V, and thereby the toner having a negative charge adheres to the image parts of the photoconductor 1. On the other hand, the electric field between the developing sleeve 9 and the non-image parts of the photoconductor 1 is directed from the developing sleeve 9 of −600V to the non-image parts of −950V. Therefore, the toner having a negative charge does not adhere to the non-image parts of the photoconductor 1. Rather, the electric field having the direction toward the developing sleeve 9 causes the toner of the developer 10 carried on parts of the developing sleeve 9 facing non-image parts of the photoconductor 1 to adhere to the developing sleeve 9. When the toner is one of the type that can be fixed to a transfer sheet at a relatively low temperature and that has a relatively strong adhering force, because of its relatively strong adhering force, the toner adhered to the developing sleeve 9 can not be easily removed.

However, when the developer 10 carried on the developing sleeve 9 passes the doctor blade 12, because the doctor blade 12 is grounded and thereby the electric potential of the doctor blade 12 is 0V, an electrostatic force acts so that toner adhered to the developing sleeve 9 is peeled off and is moved toward the doctor blade 12. Therefore, the toner adhered to a part of the developing sleeve 9 facing non-image parts of the photoconductor 1 is peeled off and is moved to adhere to the doctor blade 12. Thus, adhering and fixing of toner to the developing sleeve 9 is prevented.

The quantity of toner adhered to the doctor blade 12 gradually increases if the adhered toner remains adhered to the doctor blade 12, thereby decreasing the force which attracts the toner adhered to the developing sleeve 9 toward the doctor blade 12.

However, because the carrier of the developer 10 has the average particle diameter of 50 $\mu$m or smaller and the charge amount thereof after the developer 10 has been stirred by the stirring member 11 is 15 $\mu$c/g or greater, when the developer 10 carried on the developer sleeve 9 passes the doctor blade 12, toner adhered to the doctor blade 12 is trapped by the carrier of the developer 10 on the developing sleeve 9 due to the electric charge of the carrier. Thereby, the quantity of toner that adheres to the doctor blade 12 is suppressed, such that the force which attracts the toner adhered to the developing sleeve 9 to the doctor blade 12 is not deteriorated.

The charge amount of carrier is preferably 15 $\mu$c/g (and more preferably 25 $\mu$c/g) or greater after the developer 10 has been stirred for 10 seconds under the condition that the developer 10 having a toner density of 2.5% is contained in the developer container 8 of the developing device 4 and under the environmental condition that the temperature is 23°±3° C. and the humidity is 65±5%.

Figure 3:
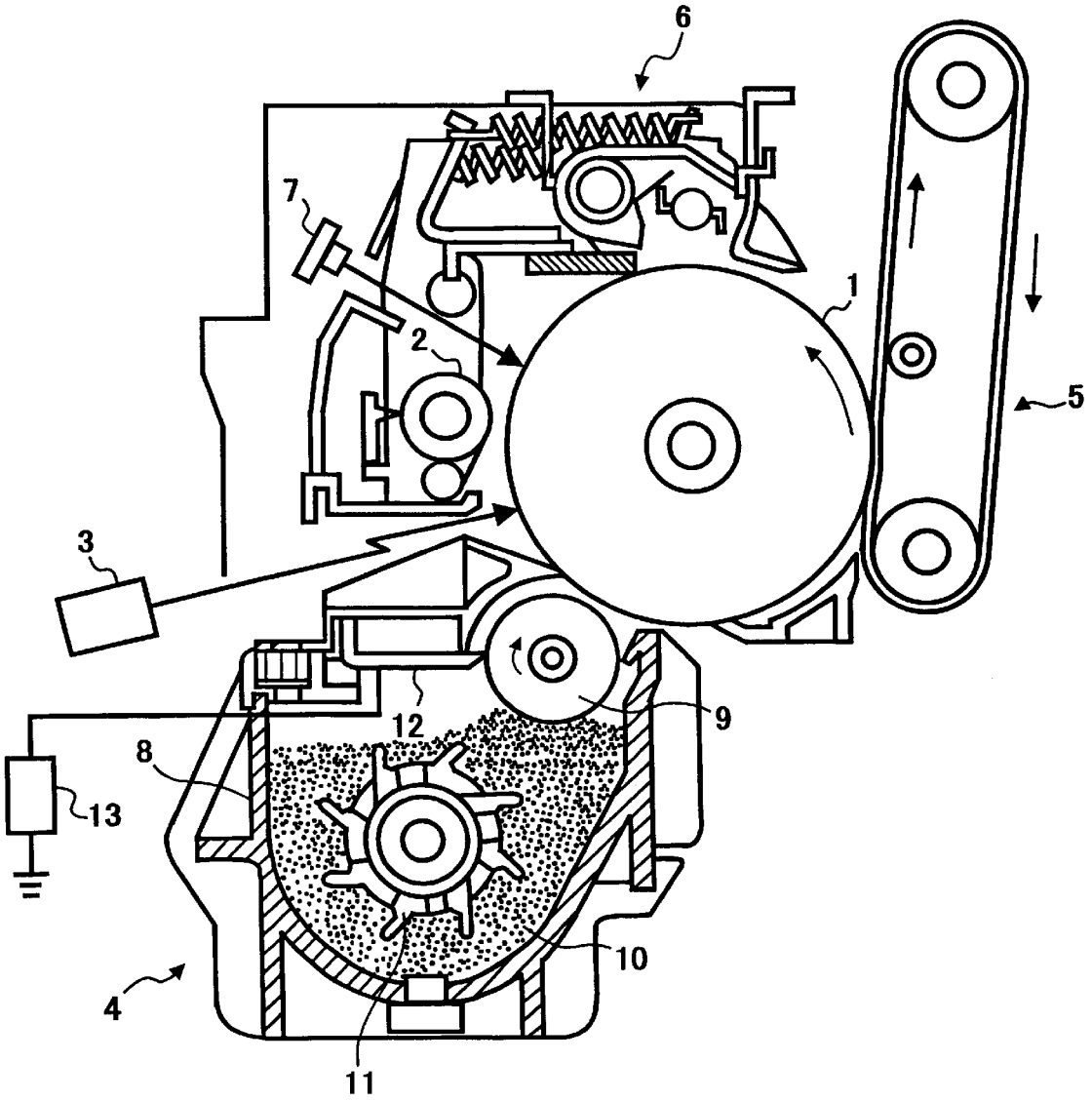
FIG. 3 is a drawing schematically illustrating an image forming apparatus including a developing device according to another preferred embodiment of the present invention.
Figure 4:
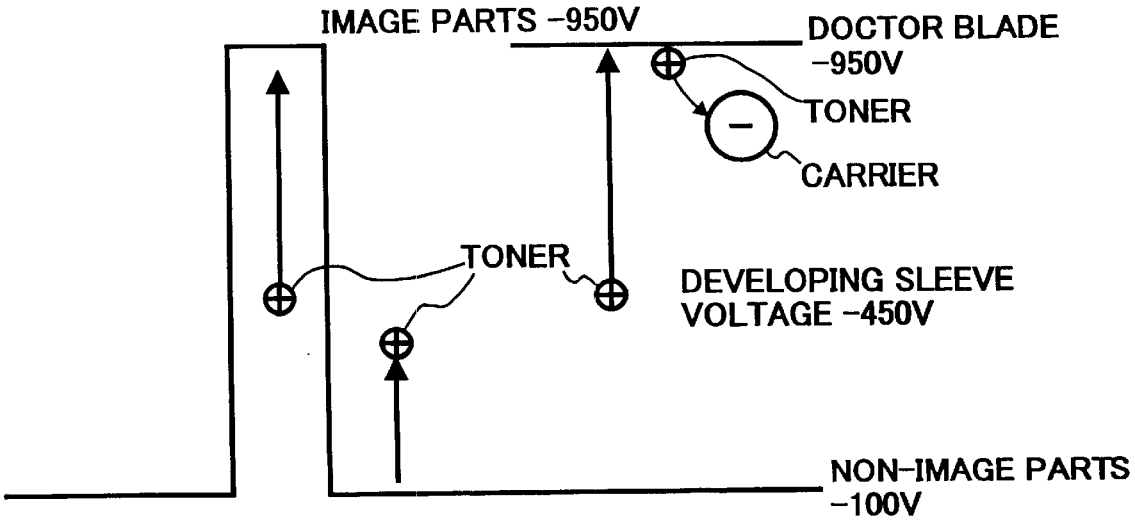
FIG. 4 is a diagram for explaining an operation of the developing device of FIG. 3.
Figure 5:
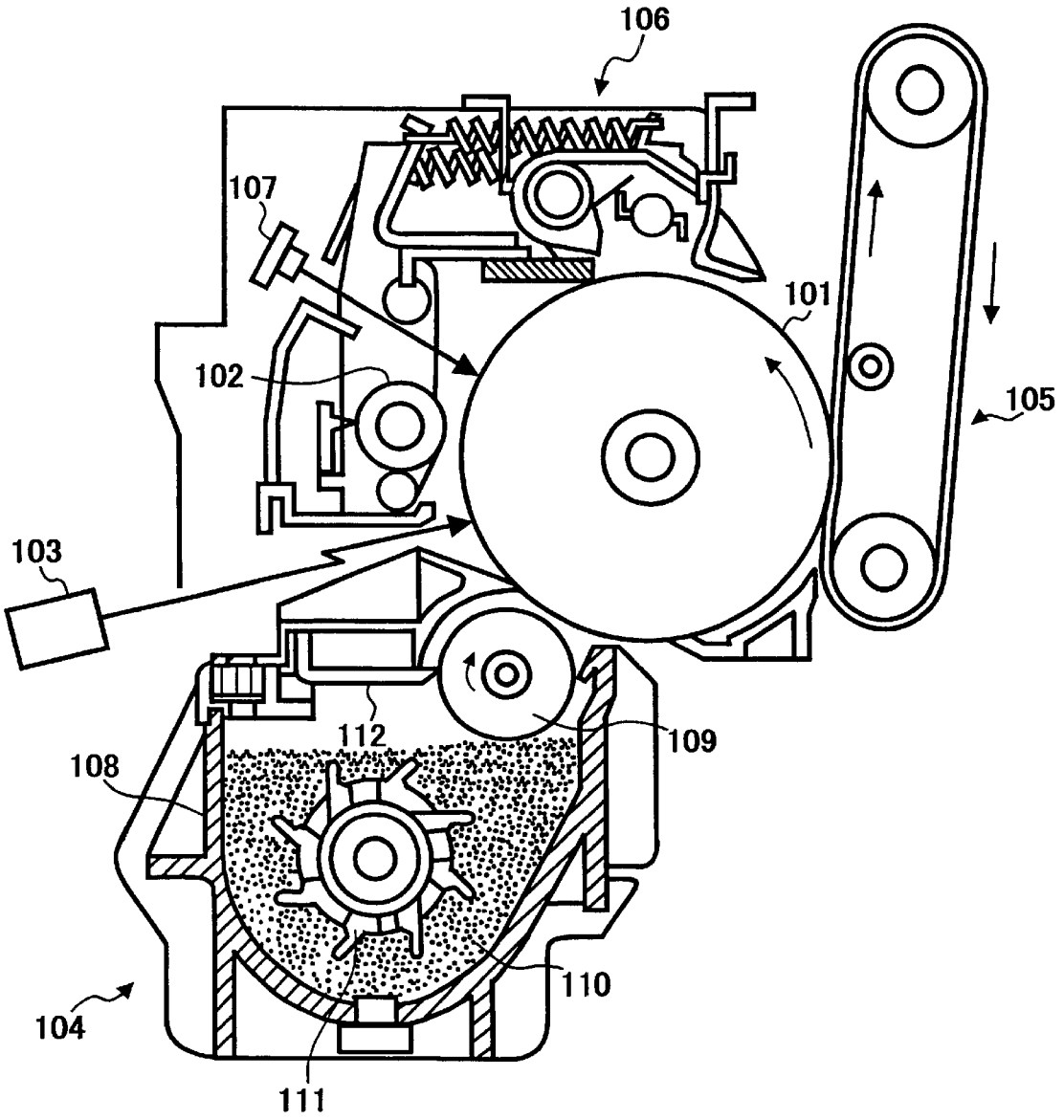
FIG. 5 BACKGROUND ART
FIG. 5 is a drawing schematically illustrating an image forming apparatus including a background developing device.
Figure 6:
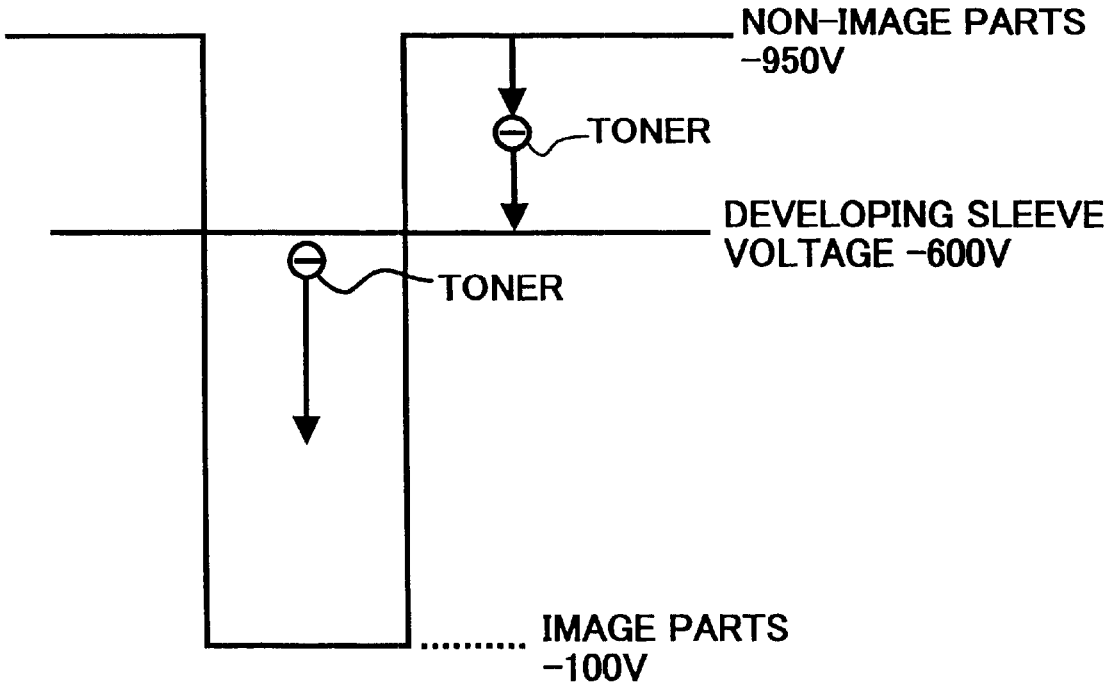
FIG. 6 BACKGROUND ART
FIG. 6 is a diagram for explaining an operation of the background developing device of FIG. 5.

Now, another preferred embodiment of a developing device according to the present invention is described referring to FIGS. 3 and 4. FIG. 3 is a schematic drawing illustrating an image forming apparatus using the developing device. FIG. 4 is a diagram for explaining an operation of the developing device. In FIG. 3, the same components as those in FIG. 1 are denoted by the same reference numerals as those in FIG. 1.

The doctor blade 12 of the developing device 4 is formed by a conductive member. In the embodiment of FIGS. 3 and 4, a voltage having a polarity opposite to that of the toner is applied to the doctor blade 12 by an electric source 13. The average particle diameter of carrier used in the developer 10 is 50 μm or smaller, and the charge amount of the carrier after the developer 10 has been stirred by the stirring member 11 is 15 μc/g or greater.

By thus configuring the developing device 4, the doctor blade 12 can remove toner adhered to the developing sleeve 9 from the developing sleeve 9 by a force that is stronger than in the development device 4 of the previous embodiment.

The above-described embodiment can be applied not only to a developing device of a reversal (negative-to-negative) development system, but also to a developing device of a positive-to-positive development system, in which the developing sleeve 9 is charged to an electric potential opposite to that of the toner and the toner is moved to a latent image on the photoconductor 1 so as to adhere thereto by an electric field formed between the developing sleeve 9 and the latent image on the photoconductor 1.

In a developing device of a positive-to-positive development system, because a latent image is formed by a reflecting light from an original document as in an analog type copying machine, the electric potential of non-image (background) parts of the surface of the photoconductor 1 changes and the electric potential of image parts thereof is maintained. When toner having a positive polarity is used for development of the latent image, the difference between the electric potentials of the photoconductor 1 and the developing sleeve 9 is configured as illustrated in FIG. 4.

The electric potential of the photoconductor 1 is set for example to −950V and an electric field is formed as illustrated in FIG. 4. A voltage having a polarity opposite to that of the toner is applied to the developing sleeve 9 (e.g. −450V). In this case, when a reflecting light from an original document is irradiated by the exposure device 3 on a surface of the photoconductor 1 which has been charged, the electric potential of image parts of the photoconductor 1 is maintained at −950V and the electric potential of non-image parts of the photoconductor 1 changes to about −100V. Thereby, the electric field between the developing sleeve 9 and the image parts of the photoconductor 1 is directed from the developing sleeve 9 of −450V to the image parts of −950V, and thus toner having a positive polarity adheres to the image parts of the photoconductor 1. On the other hand, because the electric field between the developing sleeve 9 and the non-image parts of the photoconductor 1 is directed from the non-image parts of −100V to the developing sleeve 9 of −450V, the toner having a positive polarity does not adhere to the non-image parts of the photoconductor 1.

In this configuration, even if the doctor blade 12 is grounded, an electric field that causes toner adhered to the developing sleeve 9 to be peeled off from the developing sleeve 9 cannot be formed. In order to peel off the adhered toner from the developing sleeve 9, as illustrated in FIGS. 3 and 4, a voltage having a polarity opposite to that of the toner must be applied to the doctor blade 12 by the electric source 13.

The charge amount of the carrier is preferably 15 μc/g (and more preferably 25 μc/g) or greater after the developer 10 has been stirred for about 10 seconds by the stirring member 11 under the condition that the developer 10 in the developer container 8 of the developing device 4 has a toner density of about 2.5% and under the environmental condition that the temperature is 23°±3° C. and the humidity is 65±5%.

Obviously, numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A developing device of an image forming apparatus using a two-component developer including toner and carrier, the developing device comprising:

a developer stirring device configured to stir the developer so as to charge the toner of the developer;

a developing sleeve configured to rotate and to carry on its surface the developer; and a conductive doctor blade that is grounded and is configured to regulate a thickness of the developer on the developing sleeve;

wherein, an electric potential of the developing sleeve is set to a same electric polarity as that of the toner, and the toner of the developer carried on the developing sleeve is moved toward a latent image formed on a photoconductor of the image forming apparatus so as to adhere to the latent image by an electric field formed between the developing sleeve and the latent image on the photoconductor, an average particle diameter of the carrier is about 50 μm or smaller, and a charge amount of the carrier after the developer has been stirred by the developer stirring device is about 15 μc/g or greater.

2. A developing device according to claim 1, wherein the charge amount of the carrier after the developer has been stirred by the developer stirring device is about 25 μc/g or greater.

3. A developing device of an image forming apparatus using a two-component developer including toner and carrier, the developing device comprising:

a developer stirring device configured to stir the developer so as to charge the toner of the developer;

a developing sleeve configured to rotate and to carry on its surface the developer; and a conductive doctor blade configured to regulate a thickness of the developer on the developing sleeve, a voltage of an electric polarity opposite to that of the toner being applied to the doctor blade;

wherein, the toner of the developer carried on the developing sleeve is moved toward a latent image formed on a photoconductor of the image forming apparatus so as to adhere to the latent image by an electric field formed between the developing sleeve and the latent image on the photoconductor, an average particle diameter of the carrier is about 50 μm or smaller, and a charge amount of the carrier after the developer has been stirred by the developer stirring device is about 15 μc/g or greater.

4. A developing device according to claim 3, wherein the charge amount of the carrier after the developer has been stirred by the developer stirring device is about 25 μc/g or greater.

5. A developing device of an image forming apparatus using a two-component developer including toner and carrier, the developing device comprising:

means for charging the toner of the developer;

means for carrying the developer; and means for regulating a thickness of the developer on the developer carrying means, the regulating means being conductive and grounded;

wherein, an electric potential of the developer carrying means is set to a same electric polarity as that of the toner, and the toner of the developer carried on the developer carrying means is moved toward a latent image formed on a photoconductor of the image forming apparatus so as to adhere to the latent image by an electric field formed between the developer carrying means and the latent image on the photoconductor, an average particle diameter of the carrier is about 50 μm or smaller, and a charge amount of the carrier after the developer has been stirred by the developer stirring means is about 15 μc/g or greater.

6. A developing device according to claim 5, wherein the charge amount of the carrier after the developer has been stirred by the developer stirring device is about 25 μc/g or greater.

7. A developing device of an image forming apparatus using a two-component developer including toner and carrier, the developing device comprising:

means for charging the toner of the developer;

means for carrying the developer; and means for regulating a thickness of the developer on the developer carrying means, the regulating means being conductive and a voltage of an electric polarity opposite to that of the toner being applied to the regulating means;

wherein, the toner of the developer carried on the developer carrying means is moved toward a latent image formed on a photoconductor of the image forming apparatus so as to adhere to the latent image by an electric field formed between the developer carrying means and the latent image on the photoconductor, an average particle diameter of the carrier is about 50 μm or smaller, and a charge amount of the carrier after the developer has been stirred by the developer stirring means is about 15 μc/g or greater.

8. A developing device according to claim 7, wherein the charge amount of the carrier after the developer has been stirred by the developer stirring device is about 25 μc/g or greater.

9. An image developing method of an image forming apparatus using a two-component developer including toner and carrier, the method comprising:

stirring the developer so as to charge the toner of the developer;

setting an electric potential of a developing sleeve of the apparatus to a same electric polarity as that of the toner;

rotating the developing sleeve, carrying on its surface the developer;

regulating a thickness of the developer on the developing sleeve by a conductive doctor blade of the apparatus, that is grounded; and moving the toner of the developer carried on the developer sleeve toward a latent image formed on a photoconductor of the apparatus so as to adhere to the latent image by an electric field formed between the developing sleeve and the latent image on the photoconductor, wherein, an average particle diameter of the carrier is about 50 μm or smaller, and a charge amount of the carrier after the developer has been stirred in the developer stirring is about 15 μc/g or greater.

10. An image developing method according to claim 9, wherein the charge amount of the carrier after the developer has been stirred by the developer stirring device is about 25 μc/g or greater.

11. An image developing method of an image forming apparatus using a two-component developer including toner and carrier, the method comprising:

stirring the developer so as to charge the toner of the developer;

applying a voltage of an electric polarity opposite to that of the toner to a conductive doctor blade of the apparatus;

rotating a developing sleeve of the apparatus, carrying on its surface the developer;

regulating a thickness of the developer on the developing sleeve with the doctor blade; and moving the toner of the developer carried on the developing sleeve toward a latent image formed on a photoconductor of the apparatus so as to adhere to the latent image by an electric field formed between the developing sleeve and the latent image on the photoconductor, wherein, an average particle diameter of the carrier is about 50 μm or smaller, and a charge amount of the carrier after the developer has been stirred in the developer stirring is about 15 μc/g or greater.

12. An image developing method according to claim 11, wherein the charge amount of the carrier after the developer has been stirred by the developer stirring device is about 25 μc/g or greater.

13. An image developing method of an image forming apparatus using a two-component developer including toner and carrier and a reversal development system, the method comprising:

stirring the developer so as to charge the toner of the developer;

grounding a conductive doctor blade of the apparatus;

moving the toner adhered to a developing sleeve of the apparatus to the doctor blade by an electric field between the developing sleeve and the doctor blade; and moving the toner adhered to the doctor blade to the carrier of the developer on the developing sleeve so as to adhere thereto by an electric charge of the carrier, wherein an average particle diameter the carrier is about 50μ or smaller, and a charge amount of the carrier after the developer has been stirred in the developer stirring is about 15 μc/g or greater.

14. An image developing method according to claim 13, wherein the charge amount of the carrier after the developer has been stirred by the developer stirring device is about 25 μc/g or greater.

15. An image developing method of an image forming apparatus using a two-component developer including toner and carrier, the method comprising:

stirring the developer so as to charge the toner of the developer;

applying a voltage having a polarity opposite to that of the toner to a doctor blade of the apparatus;

moving the toner adhered to a developing sleeve of the apparatus to the doctor blade by an electric field between the developing sleeve and the doctor blade;

moving the toner adhered to the doctor blade to the carrier of the developer adhered to the developing sleeve so as to adhere thereto by an electric charge of the carrier, wherein an average particle diameter of the carrier is about 50$\mu$ or smaller, and a charging amount of the carrier after the developer has been stirred in the developer stirring is about 15 $\mu$c/g or greater.

16. An image developing method according to claim 15, wherein the charge amount of the carrier after the developer has been stirred by the developer stirring device is about 25 $\mu$c/g or greater.

17. An image forming apparatus using a two-component developer including toner and carrier, comprising:

a photoconductor configured to form a latent image thereupon; and a developing device configured to develop the latent image with the toner to a toner image, the developing device including:

a developer stirring device configured to stir the developer so as to charge the toner of the developer;

a developing sleeve configured to rotate and to carry on its surface the developer; and a conductive doctor blade that is grounded and is configured to regulate a thickness of the developer on the developing sleeve;

wherein, an electric potential of the developing sleeve is set to a same electric polarity as that of the toner, and the toner of the developer carried on the developing sleeve is moved toward the latent image formed on the photoconductor so as to adhere to the latent image by an electric field formed between the developing sleeve and the latent image on the photoconductor, an average particle diameter of the carrier is about 50 $\mu$m or smaller, and a charge amount of the carrier after the developer has been stirred by the developer stirring device is about 15 $\mu$c/g or greater.

18. An image forming apparatus according to claim 17, wherein the charge amount of the carrier after the developer has been stirred by the developer stirring device is about 25 $\mu$c/g or greater.

19. An image forming apparatus using two-component developer including toner and carrier, comprising:

a photoconductor configured to form a latent image thereupon; and a developing device configured to develop the latent image with the toner to a toner image, the developing device including:

a developer stirring device configured to stir the developer so as to charge the toner of the developer;

a developing sleeve configured to rotate and to carry on its surface the developer; and a conductive doctor blade configured to regulate a thickness of the developer on the developing sleeve, a voltage of an electric polarity opposite to that of the toner being applied to the doctor blade;

wherein, the toner of the developer carried on the developing sleeve is moved toward the latent image formed on the photoconductor so as to adhere to the latent image by an electric field formed between the developing sleeve and the latent image on the photoconductor, an average particle diameter of the carrier is about 50 $\mu$m or smaller, and a charge amount of the carrier after the developer has been stirred by the developer stirring device is about 15 $\mu$c/g or greater.

20. An image forming apparatus according to claim 19, wherein the charge amount of the carrier after the developer has been stirred by the developer stirring device is about 25 $\mu$c/g or greater.

21. An image forming apparatus using a two-component developer including toner and carrier, comprising:

photoconductor means for forming a latent image thereupon; developing means for developing the latent image with the toner to a toner image, the developing means including:

means for charging the toner of the developer;

means for carrying the developer; and means for regulating a thickness of the developer on the developer carrying means, the regulating means being conductive and grounded;

wherein, an electric potential of the developer carrying means is set to a same electric polarity as that of the toner, and the toner of the developer carried on the developer carrying means is moved toward the latent image formed on the photoconductor so as to adhere to the latent image by an electric field formed between the developer carrying means and the latent image on the photoconductor, an average particle diameter of the carrier is about 50 $\mu$m or smaller, and a charge amount of the carrier after the developer has been stirred by the developer stirring means is about 15 $\mu$c/g or greater.

22. An image forming apparatus according to claim 21, wherein the charge amount of the carrier after the developer has been stirred by the developer stirring device is about 25 $\mu$c/g or greater.

23. An image forming apparatus using a two-component developer including toner and carrier, comprising:

photoconductor means for forming a latent image thereupon;

developing means for developing the latent image with the toner to a toner image, the developing means including:

means for charging the toner of the developer;

means for carrying the developer; and means for regulating a thickness of the developer on the developer carrying means, the regulating means being conductive and a voltage of an electric polarity opposite to that of the toner being applied to the regulating means;

wherein, the toner of the developer carried on the developing sleeve is moved toward the latent image formed on the photoconductor so as to adhere to the latent image by an electric field formed between the developer carrying means and the latent image on the photoconductor, an average particle diameter of the carrier is about 50 $\mu$m or smaller, and a charge amount of the carrier after the developer has been stirred by the developer stirring means is about 15 $\mu$c/g or greater.

24. An image forming apparatus according to claim 23, wherein the charge amount of the carrier after the developer has been stirred by the developer stirring device is about 25 μc/g or greater.

25. An image forming method of an image forming apparatus using a two-component developer including toner and carrier, the method comprising:

forming a latent image on a photoconductor;

developing the latent image with the toner to a toner image by a developing device, the developing step including:

stirring the developer so as to charge the toner of the developer;

setting an electric potential of a developing sleeve of the developing device to a same electric polarity as that of the toner;

rotating the developing sleeve, carrying on its surface the developer;

regulating a thickness of the developer on the developing sleeve by a conductive doctor blade of the developing device, that is grounded; and moving the toner of the developer carried on the developing sleeve toward the latent image formed on the photoconductor so as to adhere to the latent image by an electric field formed between the developing sleeve and the latent image on the photoconductor;

wherein, an average particle diameter of the carrier is about 50 μm or smaller, and a charge amount of the carrier after the developer has been stirred in the developer stirring is about 15 μc/g or greater.

26. An image forming method according to claim 25, wherein the charge amount of the carrier after the developer has been stirred by the developer stirring device is about 25 μc/g or greater.

27. An image forming method of an image forming apparatus using a two-component developer including toner and carrier, the method comprising:

forming a latent image on a photoconductor;

developing the latent image into a toner image with the toner by a developing device, the developing step including:

stirring the developer so as to charge the toner of the developer;

applying a voltage of an electric polarity opposite to that of the toner to a conductive doctor blade of the developing device;

rotating a developing sleeve of the developing device, carrying on its surface the developer;

regulating a thickness of the developer on the developing sleeve with the doctor blade; and moving the toner of the developer carried on the developing sleeve toward the latent image formed on the photoconductor so as to adhere to the latent image by an electric field formed between the developing sleeve and the latent image on the photoconductor, wherein, an average particle diameter of the carrier is about 50 μm or smaller, and a charge amount of the carrier after the developer has been stirred in the developer stirring is about 15 μc/g or greater.

28. An image forming method according to claim 27, wherein the charge amount of the carrier after the developer has been stirred by the developer stirring device is about 25 μc/g or greater.

29. An image forming method of an image forming apparatus using a two-component developer including toner and carrier and a reversal development system, the method comprising:

forming a latent image on a photoconductor;

developing the latent image into a toner image with the toner by a developing device, the developing step including:

stirring the developer so as to charge the toner of the developer;

grounding a conductive doctor blade of the developing device;

moving the toner adhered to a developing sleeve of the developing device to the doctor blade by an electric field between the developing sleeve and the doctor blade; and moving the toner adhered to the doctor blade to the carrier of the developer carried on the developing sleeve by an electric charge of the carrier;

wherein an average particle diameter of the carrier is about 50μ or smaller, and a charge amount of the carrier after the developer has been stirred in the developer stirring is about 15 μc/g or greater.

30. An image forming method according to claim 29, wherein the charge amount of the carrier after the developer has been stirred by the developer stirring device is about 25 μc/g or greater.

31. An image forming method of an image forming apparatus using a two-component developer including toner and carrier, the method comprising:

forming a latent image on a photoconductor;

developing the latent image into a toner image with the toner by a developing device, the developing step including:

stirring the developer so as to charge the toner of the developer;

applying a voltage having a polarity opposite to that of the toner to a doctor blade of the developing device;

moving the toner adhered to a developing sleeve of the developing device to the doctor blade by an electric field between the developing sleeve and the doctor blade;

moving the toner adhered to the doctor blade to the carrier of the developer carried on the developing sleeve by an electric charge of the carrier;

wherein an average particle diameter of the carrier is about 50μ or smaller, and a charging amount of the carrier after the developer has been stirred in the developer stirring is about 15 μc/g or greater.

32. An image forming method according to claim 31, wherein the charge amount of the carrier after the developer has been stirred by the developer stirring device is about 25 μc/g or greater.

* * * * *